United States Patent [19]

Lahmann et al.

[11] Patent Number: 4,634,160

[45] Date of Patent: Jan. 6, 1987

[54] HANDLE FITTING FOR A DRIVE ROD LOCKING ARRANGEMENT FOR WINDOWS, DOORS AND THE LIKE

[75] Inventors: Ernst Lahmann, Meerbeck; Werner Walder; Friedhelm Bürger, both of Heiligenhaus, all of Fed. Rep. of Germany

[73] Assignee: Mila Hardware & Machinery (UK) Limited, Daventry, England

[21] Appl. No.: 665,045

[22] Filed: Oct. 26, 1984

[30] Foreign Application Priority Data

Nov. 26, 1983 [DE] Fed. Rep. of Germany ... 8333991[U]

[51] Int. Cl.[4] ..... E05C 21/00

[52] U.S. Cl. ..... 292/336.3

[58] Field of Search ..... 292/98, 100, 124, 126, 292/173, 197, 200, 224, 226, 336.3, 347

[56] References Cited

U.S. PATENT DOCUMENTS 1,436,892 11/1922 Morse et al. ..... 292/173

1,601,790 10/1926 Beringer ..... 292/224

3,116,082 12/1963 Chanaryn et al. ..... 292/224

3,955,839 5/1976 Proska et al. ..... 292/226

FOREIGN PATENT DOCUMENTS 1023269 12/1952 France .

*Primary Examiner*—Richard E. Moore

*Attorney, Agent, or Firm*—Fleit, Jacobson, Cohn & Price

[57] ABSTRACT

A handle fitting for a drive rod locking arrangement for windows, doors and the like, in which a drive rod actuating lever (4) is mounted in a housing (1) for pivotal movement about an axis B and an actuating handle is rotatable about an axis A intersecting the axis B. The drive shaft of the operating handle includes a coupling portion (20) having a concentric shoulder (24) engaging in an opening (12) to retain the lever (4) in place and a crank (19) engages in a slot (18) in a laterally movable drive slide having a projection (17), so that lateral movement of the slide caused by the crank (19) effects pivotal movement of the lever (4).

8 Claims, 7 Drawing Figures

HANDLE FITTING FOR A DRIVE ROD LOCKING ARRANGEMENT FOR WINDOWS, DOORS AND THE LIKE

The present invention relates to a handle fitting for a drive rod locking arrangement for windows, doors and the like. One type of such a fitting includes an operating handle pivoted in a housing, and a drive rod actuating lever coupled to the operating handle, with a bearing shaft of the operating handle having an axis at right angles to the axis of the drive rod actuating lever.

Such a design is already known from DE-OS No. 2047058, where the drive rod actuating lever has a two armed layout. The arm of the drive rod actuating lever which lies inside the housing operates in conjunction with an inclined surface on the bearing shaft of the operating handle. This arrangement causes the large overall height of the housing. It also causes the handle fitting to operate with a high friction and gives a rather unsatisfactory ratio of angular movement of the handle to movement of the locking rod.

According to the present invention there is provided a handle fitting for a drive rod locking arrangement for windows, doors and the like, said fitting comprising a housing, a first bearing in said housing having a first bearing axis, an operating handle mounted on said first bearing for pivotal movement about said first axis, a second bearing in said housing having a second bearing axis which intersects said first bearing axis, a drive rod actuating lever having an inner end in the housing and a free end outside the housing, the inner end being mounted on said second bearing for pivotal movement about said second axis and coupling means for coupling said operating handle and said drive rod actuating lever, said coupling means being positioned between said second axis and the free end of the drive rod actuating lever.

The construction of the present invention has the two bearing axes intersecting one another and arranges for the coupling means to be positioned between the second axis and the free end of the drive rod actuating lever. The result of such a design is not only to save space, so that the fitting can be made much smaller, but it also provides a high gear ratio, which can be made possible by designing the drive rod actuating lever itself as a one arm construction, that is pivoted at one end. This allows the second bearing axis to be positioned close to the bottom of the housing and enables large forces to be transmitted with little friction and makes for an easier operation of the fitting. The small dimensions of the housing enables such fittings to be mounted even on very narrow window profiles. Furthermore, the favourable gear ratio allows the drive rod actuating lever to be shifted over a great distance even with the operating handle only being rotated through 90°.

Advantageously, the bearing of the drive rod actuating lever wherein said second bearing comprises an approximately circular projection on the housing and a cooperating semi-circular cut-out portion at the inner end of the drive rod actuating lever.

With such an arrangement, the coupling means may include an opening in that portion of its length of the drive rod actuating lever within the housing, one edge of this opening being concentric of the cut-out and a shoulder on a coupling portion of the operating handle engaging this one edge of the opening to retain the drive rod actuating lever in place. No separate trunion or like means is therefore required for the drive rod actuating lever, thus saving components.

Preferably the coupling portion of the operating handle is provided with an eccentric crankpin which engages a drive slide, so that rotation of the operating handle causes transverse displacement of the drive slide which includes a projection engaging in the opening of the drive rod actuating lever, so that the displacement of the drive slide causes pivoting of the drive rod actuating lever about the second axis. For this purpose it is preferred that the projection of the drive slide should engage snugly in the opening of the drive rod actuating lever so that the latter can be pivoted in either direction immediately by pivoting movement of the operating handle. The coupling portion may also have two stop surfaces, which are at right angles to each other and abut against a flat bow spring to define the two positions of handle. Any forces acting transverse to the drive rod actuating lever are completely absorbed by the positioning of the lever in a space of the housing, the inside dimensions of which are substantially equal to the thickness of the drive rod actuating lever, so that the lever is guided by the sides of the space.

In order that the invention may more readily be understood, the following description is given, merely by way of example, reference being made to the accompanying drawings, in which.

Figure 2:
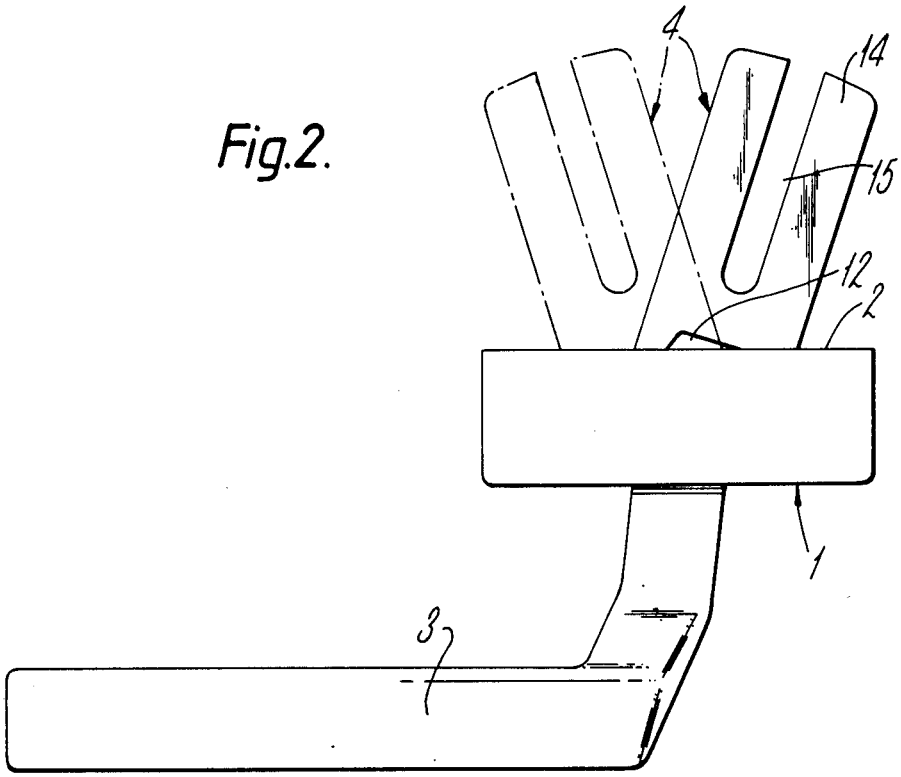
FIG. 2 is a plan view of the handle fitting of FIG. 1.
Figure 3:
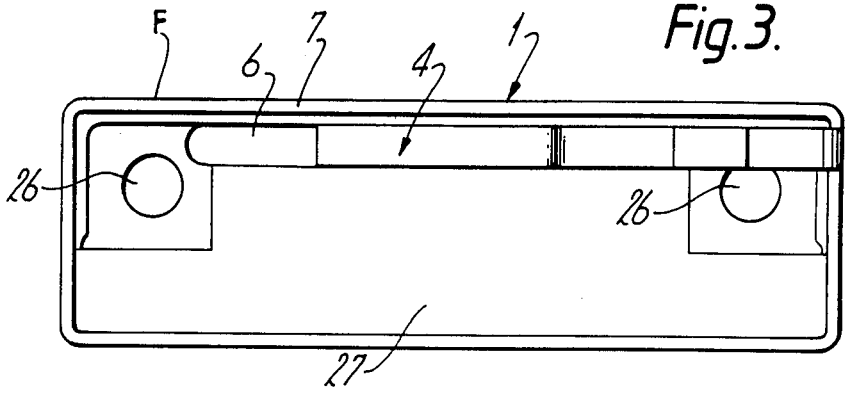
FIG. 3 is a rear view of the housing of the fitting, with its collar in place.
Figure 4:
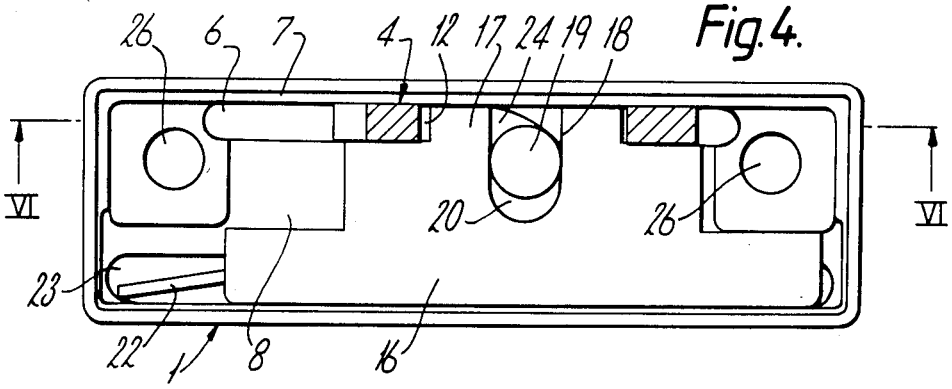
FIG. 4 is a rear view of the housing with the cover removed.
Figure 5:
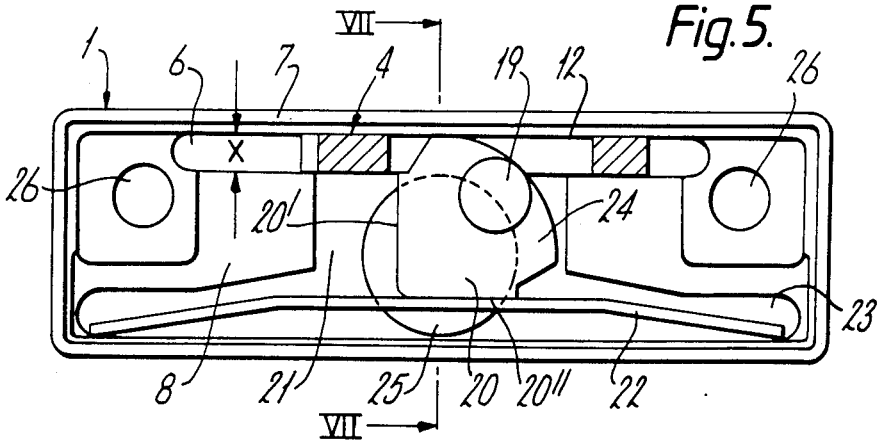
FIG. 5 is a rear view of the housing with the drive slide removed.

The handle fitting illustrated in the drawing has a screw on housing of rectangular cross-section, with the rear surface 2 of the housing extending in the plane of a wing on the window frame. Mounted on the housing 1 is an operating handle 3, shown in full line in the locked position of the window and in phantom in the opened position, when the operating handle has been turned through 90°, this movement causing a drive rod actuating lever 4 to swing from the position illustrated by a full line in FIG. 2 to the position indicated in phantom.

The inner end 5 of the drive rod actuating lever 4 protrudes into a space 6 which runs in the longitudinal direction of the housing 1. Space 6 extends to near the outer surface F of the housing 1 and is formed between two walls 7 and 8. The internal width of space 6 matches the thickness of the drive rod actuating lever 4 and thus gives the latter lateral support. The pivotal bearing for the drive rod actuating lever 4 is formed by an approximately semi-circular projection 9 of the housing 1 which extends into the space 6. This projection 9 is situated near the bottom 10 of the housing and extends in the transverse median plane of the housing 1. To allow the lever 4 to swivel around projection 9, its inner end 5 is formed with an approximately semi-circular cut-out 11.

Figure 6:
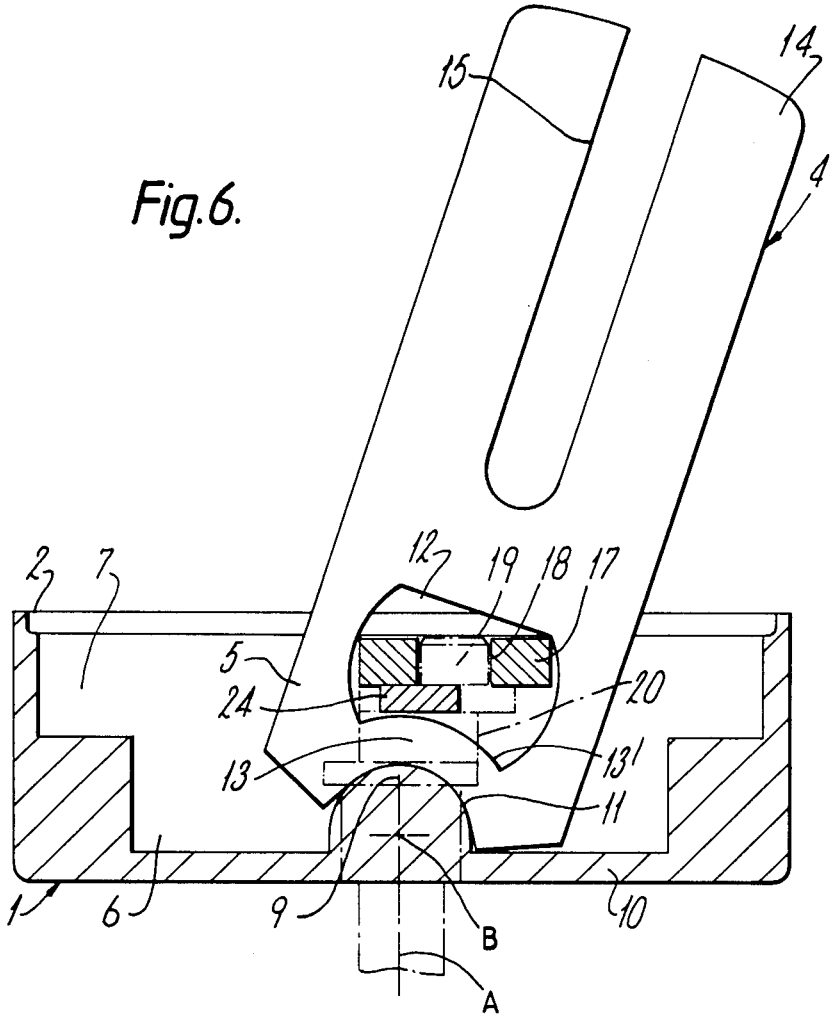
FIG. 6 is a section taken along the line VI—VI in FIG. 4.

Above the cut-out 11 and still within the housing, the lever 4 is formed with an opening 12 separated from the cutout 11 by an arch 13, the upper surface 13' of which is concentric with bearing axis B of the lever 4, as shown in FIG. 6.

Figure 1:
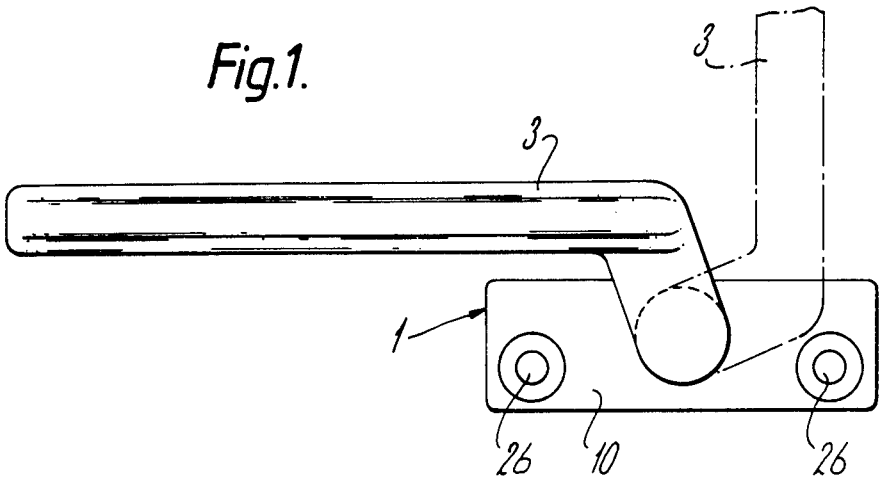
FIG. 1 is a front elevation of one embodiment of handle fitting according to the present invention.

The free end 14 of the lever 4 includes a slot 15, thus forming a fork, which receives a drive rod coupling element which is not illustrated. A drive slide 16 is movable in the longitudinal direction of the housing 1 and is symmetrical about its transverse median axis. A coupling projection 17 extends upwardly from the slide 16 and engages snugly in opening 12, and an open ended slot 18 extends to the free edge of the coupling projection 17, in a direction transverse to the direction of movement of the drive slide 16. Handle 3 is mounted on a shaft 25 rotatable in a cooperating bearing in housing 1 and includes a coupling portion 20 provided with a crankpin 12, which engages snugly in the slot 18. The coupling portion 20 lies in a recess 21 of wall 8. On the side of coupling portion 20 which is opposite opening 12 of the lever 4, the coupling portion 20 has two flat stop surfaces 20' and 20'', perpendicular to each other. When the operating handle 3 is in the position indicated in full line in FIG. 1, the stop surface 20'' will abut against a curved flat bow spring 22, the ends of which are fitted into recesses 23, which are longitudinal extensions of a recess 21. It is thus possible to retain the operating handle either in this position or in the phantom line position shown in FIG. 1, with the stop surface 20' engaging spring 22. The axial position of lever 4 is secured by a concentric shoulder 24 on the coupling portion 20, which engages the upper surface 13' of arch 13, a portion of the shoulder 24 extending into opening 12. The coupling portion 20 is formed integrally with the shaft 25, the part 26 of which, that protrudes outside the housing 1 being of square cross-section, enabling a tight fit between the operating handle 3 and the shaft 25. A turn of the operating handle will thus cause a displacement of the coupling portion 20, so that crankpin 19 will displace the drive slide 16 which, via its coupling projection 17, swivels the drive rod actuating lever 4. During this swivelling action, the crankpin 19 will extend further into the opening in the lever 4. After any 90° turn by operating handle 3, one of the slot surfaces 20', 20'', will abut against the spring 22. As illustrated especially in FIGS. 6 and 7, the two bearing axes A and B intersect each other between the operating handle and the drive rod actuating lever, near the bottom of the housing 1. Since the coupling position within the area of opening 12 lies between the operating handle and the lever 4 and is thus adjacent to the bearing of the lever 4, it is possible to obtain an efficient ratio of angular movement of the handle to movement of the locking rod and yet construct the housing with small dimension.

Figure 7:
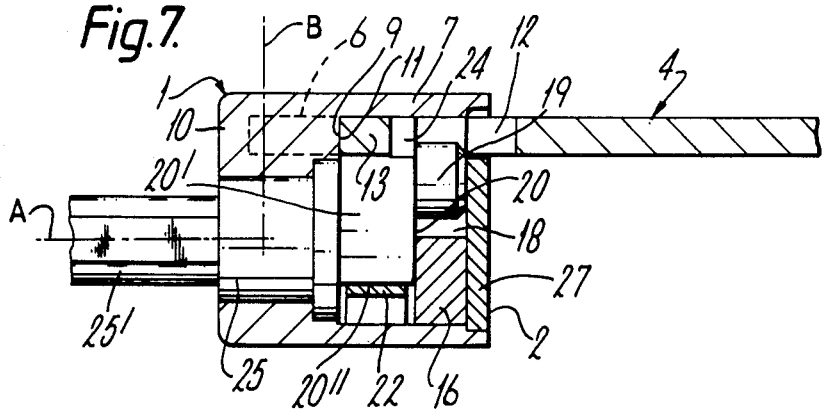
FIG. 7 is a section taken along the line VII—VII in FIG. 5.

As will be seen especially from FIG. 7, both the shaft 25 and the lever 4 are arranged so as to be laterally spaced by only a small amount, this again enabling housing 1 to be small. For fastening the housing 1 to the wing of a window frame, countersunk bores 26 have been provided near the ends of the housing 1 for screws (not shown). A cover 27 is provided which is inserted into the housing from the rear surface 2, to cover the inside of the box.

We claim:

1. A handle fitting for a drive rod locking arrangement for windows, doors and the like, said fitting comprising a housing, a first bearing in said housing having a first bearing axis, an operating handle mounted on said first bearing for pivotal movement about said first axis, a second bearing in said housing having a second bearing axis which intersects said first bearing axis, a drive rod actuating lever connectable to the drive rod locking arrangement, said lever having an inner end in the housing and a free end outside the housing, the inner end being mounted on said second bearing for pivotal movement about said second axis and coupling means for coupling said operating handle and said drive rod actuating lever, said coupling means being positioned between said second axis and the free end of the drive rod actuating lever, said coupling means including an opening in that portion of the length of the drive rod actuating lever within the housing, said opening having one edge concentric with said second axis, and further comprising a coupling portion of the operating handle and a shoulder on said coupling portion engaging said one edge of the opening effective to retain the drive rod actuating lever in place.

2. A handle fitting as claimed in claim 1, wherein said second bearing comprises an approximately circular projection on the housing and a cooperating semi-circular cut-out portion at the inner end of the drive rod actuating lever, said cut-out portion being substantially concentric with said edge.

3. A handle fitting as claimed in claim 2, wherein said coupling means includes an opening in that portion of the length of the drive rod actuating lever within the housing, said opening having one edge concentric with said semi-circular cut-out at the inner end of the drive rod actuating lever, and further comprising a coupling portion of the operating handle and a shoulder on said coupling portion engaging said one edge of the opening effective to retain the drive rod actuating lever in place.

4. A handle fitting as claimed in claim 1, wherein said coupling portion further comprises an eccentric crankpin and a drive slide within said housing engaged by said crankpin whereby rotation of the operating handle causes transverse displacement of the drive slide and a projection on said drive slide engaging in the opening of the drive rod actuating lever, whereby the displacement of the drive slide causes pivotal movement of the drive rod actuating lever about said second axis.

5. A handle fitting according to claim 4, wherein said projection of the drive slide engages snugly in said opening of the drive rod actuating lever.

6. A handle fitting as claimed in claim 1, and further comprising a recess in a wall of the housing in which said coupling portion of the operating handle lies.

7. A handle fitting as claimed in claim 1, wherein said coupling portion further comprises two stop surfaces which are at right angles to each other and wherein said housing further comprises a flat bow spring against which said stop surfaces can selectively engage to hold said handle against inadvertent rotation.

8. A handle fitting as claimed in claim 1, wherein said housing includes an inner space whose inside dimension is substantially equal to the thickness of the drive rod actuating lever, said lever being engaged in said space, so that the lever is guided by the sides of the space during its pivotal movement.

* * * * *